United States Patent [19]

Stoller, Sr. et al.

[11] 4,437,410

[45] Mar. 20, 1984

[54] PIVOTAL SLIDABLE VEHICLE END ENCLOSURE

[75] Inventors: David A. Stoller, Sr., Dunwoody, Ga.; James C. Robertson, Ypsilanti; Tibor Matyas, Northville, both of Mich.

[73] Assignee: Portec, Inc., Oak Brook, Ill.

[21] Appl. No.: 310,307

[22] Filed: Oct. 9, 1981

[51] Int. Cl.[3] ..... B61D 3/02; B60J 5/10

[52] U.S. Cl. ..... 105/378; 16/82; 16/87.6 R; 16/223; 16/DIG. 20; 160/196 D; 292/97; 292/DIG. 49; 410/26

[58] Field of Search ..... 105/378, 410; 410/4, 410/26; 160/196 R, 196 D, 205; 292/26, 97, 123, DIG. 49; 16/82, 87.6 R, 87.8, 94 R, 223, 386, DIG. 20

[56] References Cited

U.S. PATENT DOCUMENTS

| | | | |
|---|---|---|---|
| 2,615,514 | 10/1952 | Hickling et al. | 160/196 X |
| 2,616,648 | 11/1952 | Budreck | 16/223 X |
| 2,824,339 | 2/1958 | Shaver | 105/378 X |
| 2,929,115 | 3/1960 | Beckstrom | 105/378 X |
| 3,017,655 | 1/1962 | Check | 16/82 |
| 3,071,825 | 1/1963 | Ferris | 160/196 X |
| 3,413,025 | 11/1968 | Sperry | 292/26 X |
| 3,829,929 | 8/1974 | Foltz et al. | 16/223 X |
| 3,996,860 | 12/1976 | Ravani et al. | 105/378 X |
| 4,116,135 | 9/1978 | Jaekle et al. | 410/26 |
| 4,240,357 | 12/1980 | Phillips | 105/378 |
| 4,318,349 | 3/1982 | Galasan | 105/378 |

*Primary Examiner*—Randolph Reese
*Attorney, Agent, or Firm*—Emory L. Groff, Jr.

[57] ABSTRACT

An enclosure for the end opening of a vehicle having one or more interior elevated decks includes a pair of door assemblies each comprising a plurality of pivotally joined panels. The door assemblies are suspended in a vertical manner by means of hanger assemblies having tracking elements guided within a rail member disposed above the level of a vehicle elevated deck. Transverse movement of any panel concurrently displaces the entire associated door assembly, as a unitary articulated assembly, between a closed position sealing off the end opening, and an open position with the door assembly well-spaced from a lateral edge of the deck, in which latter position maximum lateral clearance is provided for lading carried by all decks or levels. With the vehicle provided with a raised top section or pitched roof, an enclosure is obtained for the upper portion of the end opening by the inclusion of inwardly directed top panel sections extending above each of the panels and which substantially conform to the pitch of the adjacent roof section when the door assembly is disposed in the open position.

15 Claims, 25 Drawing Figures

FIG. 19.
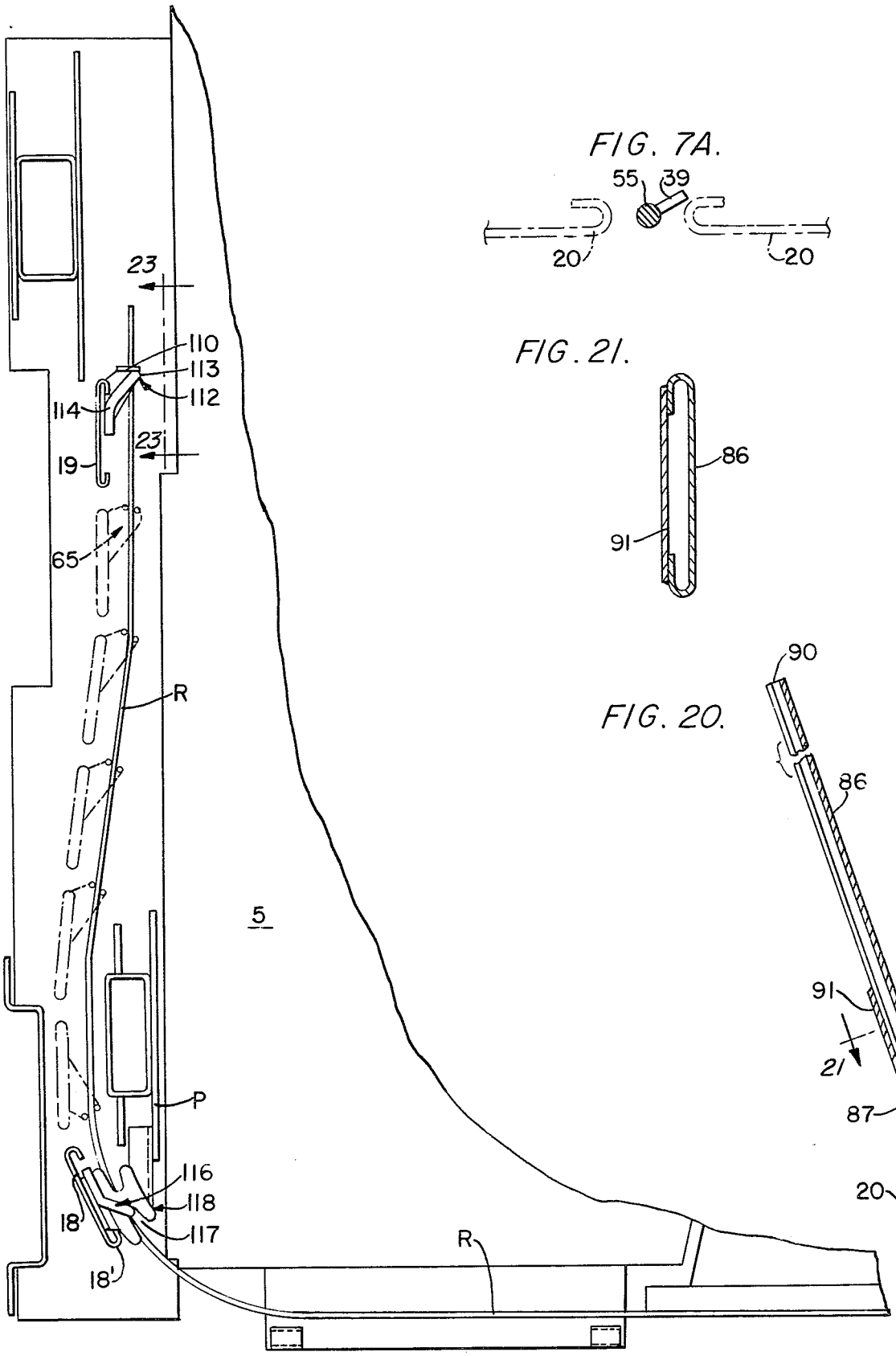
FIG. 7A.
FIG. 21.
FIG. 20.
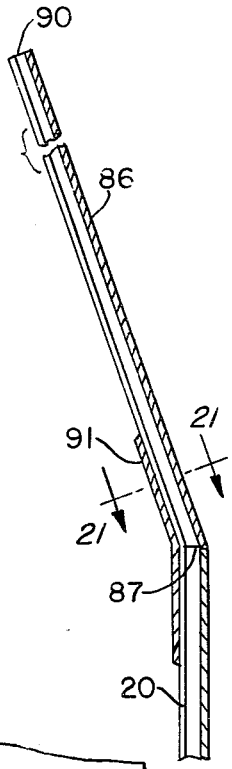

FIG. 22.
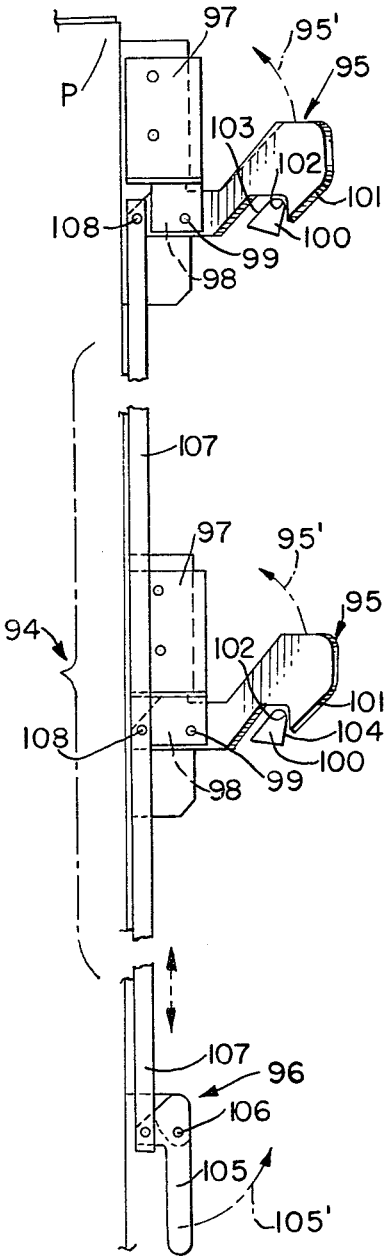
FIG. 23.
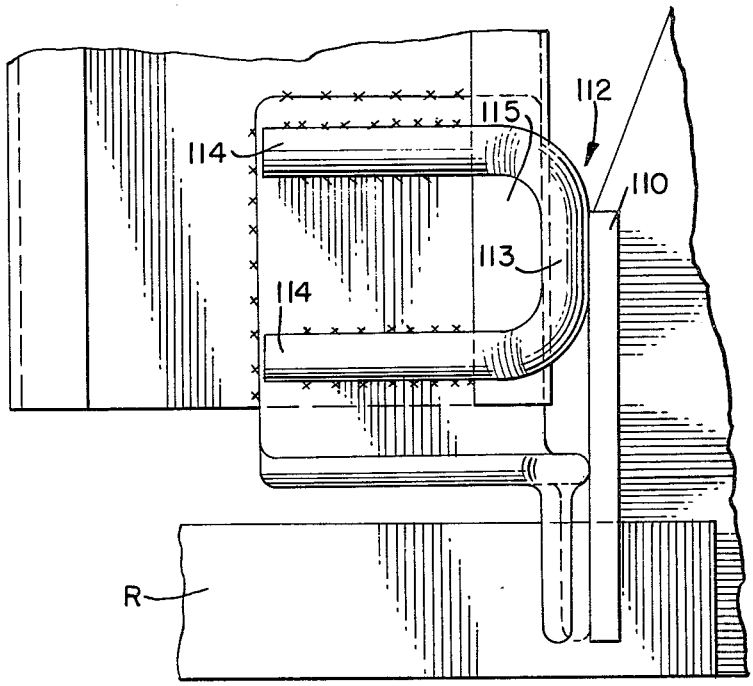
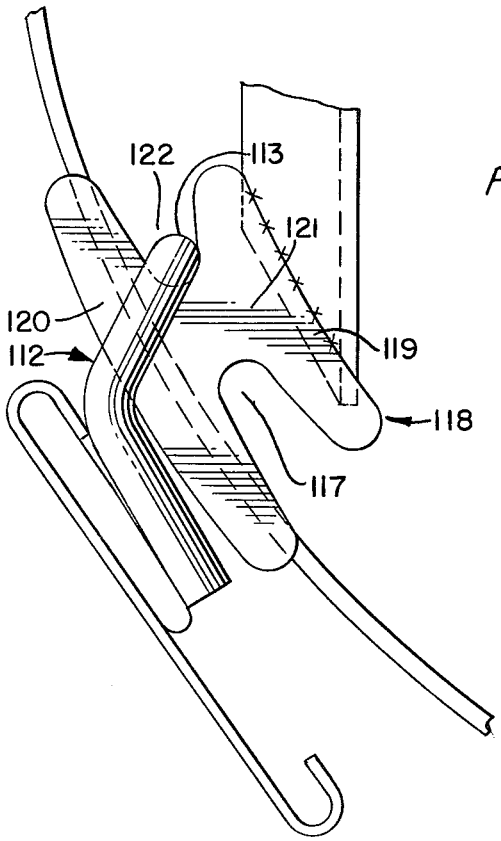
FIG. 24.

FIG. 7A is a horizontal sectional view taken along the line 7A—7A of FIG. 7;

FIG. 19 is a partial top plan view of the vehicle floor and bottom guide rail;

FIG. 20 is a vertical sectional view taken along the line 20—20 of FIG. 1;

FIG. 21 is a horizontal sectional view taken along the line 21—21 of FIG. 20.

FIG. 22 is a fragmentary vertical view taken along the line 22—22 of FIG. 1;

FIG. 23 is an elevation view taken along the line 23—23 of FIG. 19; and

FIG. 24 is a partial plan view of a closed door bumper and stop assembly.

Similar reference characters designate corresponding parts throughout the several figures of the drawings.

Figure 1:
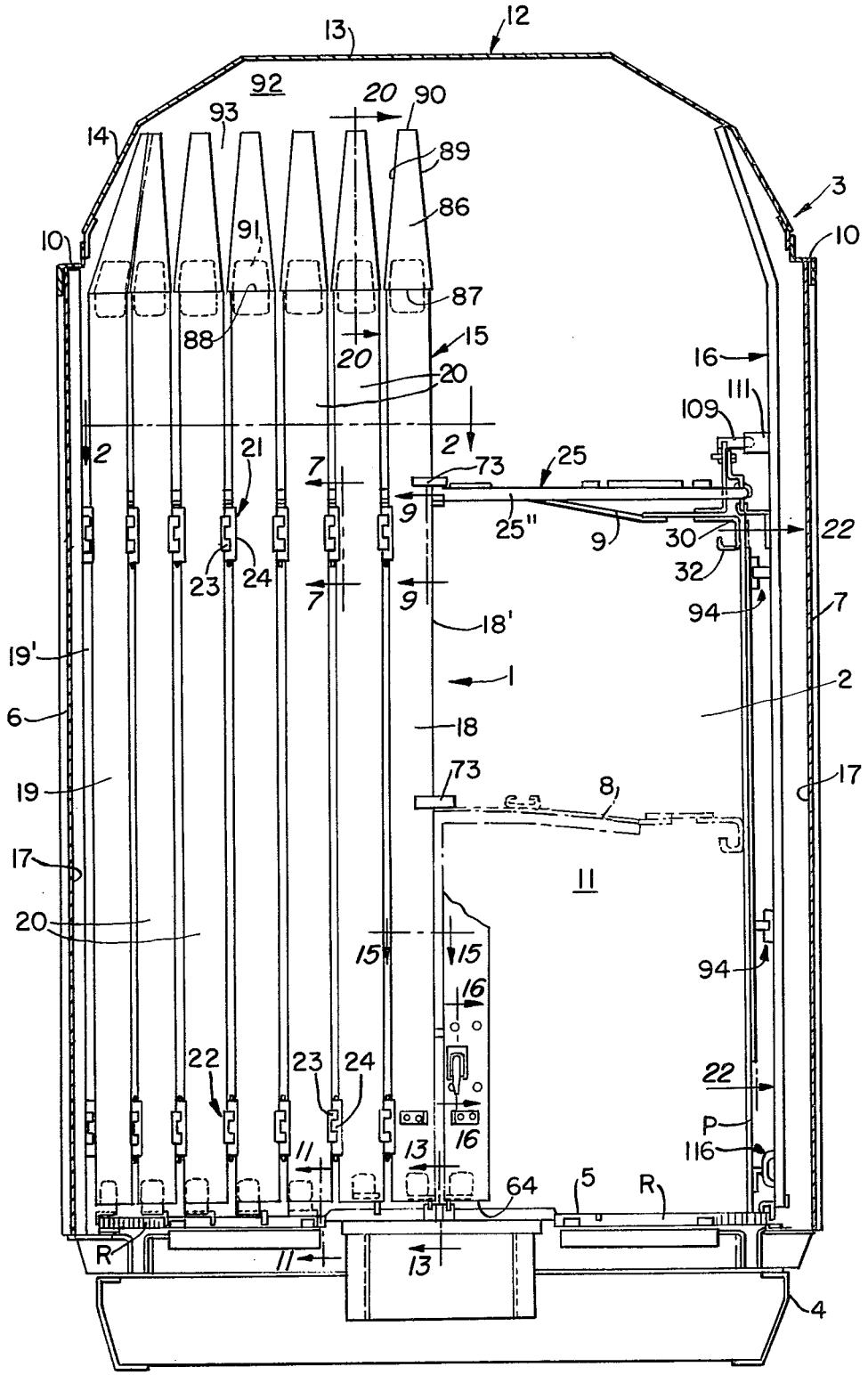

Referring now to the drawings, particularly FIG. 1, the present invention will be seen to relate to an end enclosure generally designated 1 adapted to seal off each end opening 2 of a vehicle such as the illustrated rail car 3. The vehicle includes a suitable frame diagrammatically shown at 4 upon which is disposed a floor 5 bounded by a pair of vertically disposed, laterally spaced apart side walls 6 and 7. As the end enclosure 1 of the present invention is particularly adapted to secure the end opening 2 of a rail car intended for transporting automobiles it will be appreciated that such rail cars sometimes include both an intermediate deck 8 spaced above the car floor 5 as well as an elevated or upper deck 9 disposed between the intermediate deck 8 and the top edge 10 of the car side walls. In any case, such rail cars will include at least one elevated deck as shown in full lines in FIG. 1. Additionally, to provide appropriate protection for lading carried within the interior 11 of the car 3, it is preferred to provide a roof structure 12 including a raised top section 13 joined to the top edges 10 of the two side walls 6–7 by means of one or more inclined side sections 14.

The end enclosure 1 comprises a pair of door assemblies 15–16 which will be seen to be generally mirror images of each other and are constructed to allow displacement between two alternate positions. As will be described hereinafter, this construction does include certain specific distinctions between the two door assemblies. As shown in FIG. 1, the door assembly 15 is illustrated in the closed position sealing off the left-hand portion of the end opening 2 while the door assembly 16 is illustrated in the opened or stowed position fully disposed within the interior 11 of the car juxtaposed the inner surface 17 of the car side walls. 7. Each door assembly 15 or 16 includes an inner panel 18, outer panel 19 and a plurality of intermediate panels 20 all of which are substantially identical and are constructed of a solid or imperforate material such as steel, nonferrous metal, plastic material, etc.

The plurality of panels comprising each door assembly 15–16 are pivotally joined to one another at two or more vertically spaced apart points such as by means of the upper hinge assemblies 21 and lower hinge assemblies 22 with each hinge assembly including a male hinge element 23 carried by one lateral edge of each panel and which cooperates with a female hinge element 24 carried by an adjacent edge of a justaposed panel. In view of the relatively narrow width of each of the door assembly panels, it will be appreciated that the degree of articulation afforded by each hinge assembly 21 and 22 is quite minimal, a point which will be quite obvious from a review of FIG. 2 of the drawings, which clearly illustrates the arcuate path described by each door assembly as it is displaced between the two alternate positions.

Figures 2, 3, 4, 5, 6:
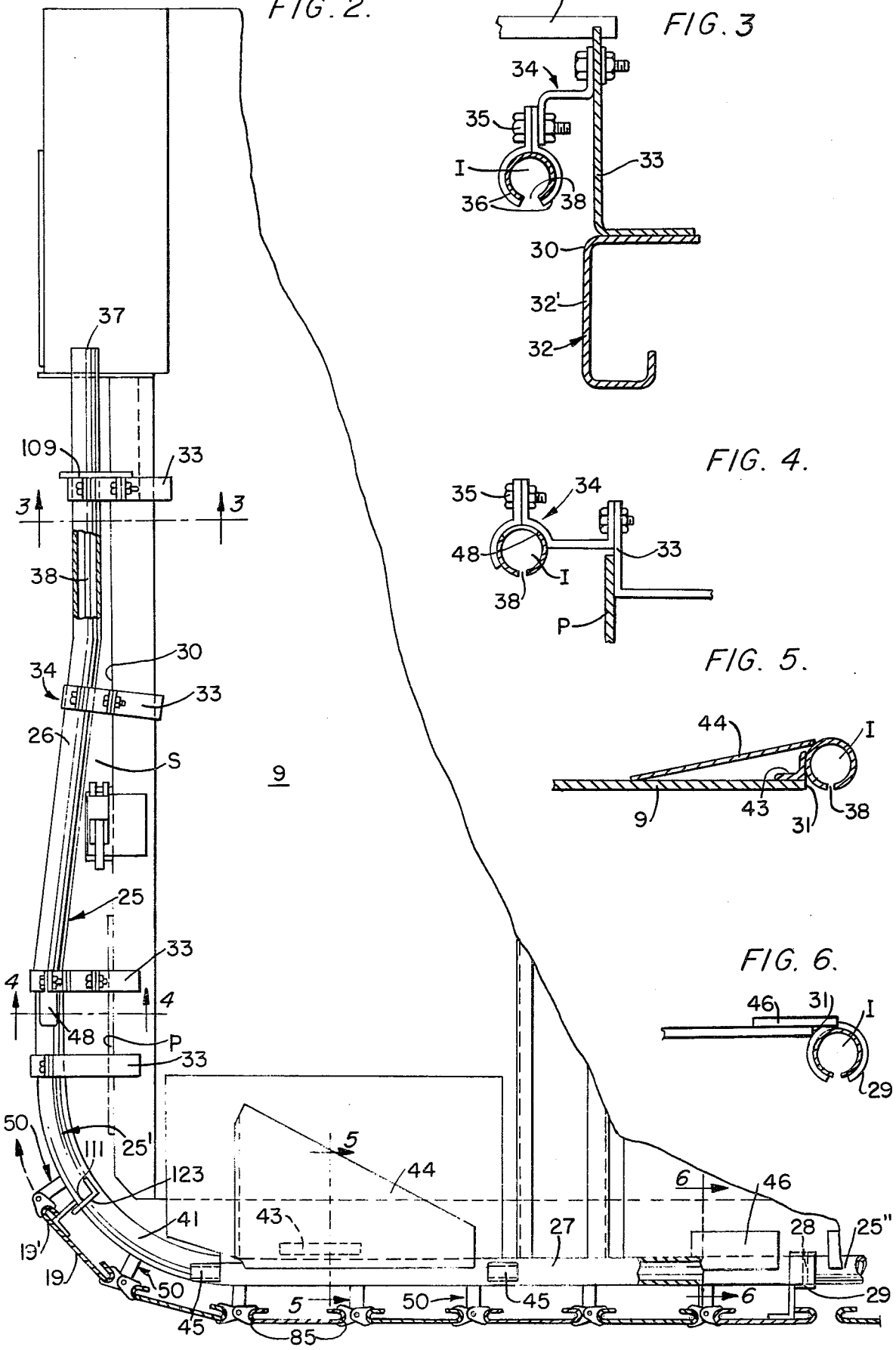

Each door assembly 15 and 16 is retained in the vertically disposed manner as shown in FIG. 1 by means of a support member 25 comprising an elongated, suitable track element disposed in a horizontal plane at a level essentially above the elevated deck 9 and which from FIG. 2, which depicts only one-half of the member 25, will be seen to define a substantially U-shaped configuration in plan view. In cross-section the track element may be circular as shown or comprise other forms such as rectangular, square etc. Alternately, for ease of manufacture, assembly and subsequent repair or replacement, the support member 25 may be divided into a left-section 25′ and a right-section 25″ with each comprising a side portion 26 integral with an end portion 27. If the support member is formed by two sections 25′–25″, the juxtaposed ends 28—28 of the two sections are suitably joined by an appropriate union member 29 as shown most clearly in FIG. 2 of the drawings.

Figure 18:
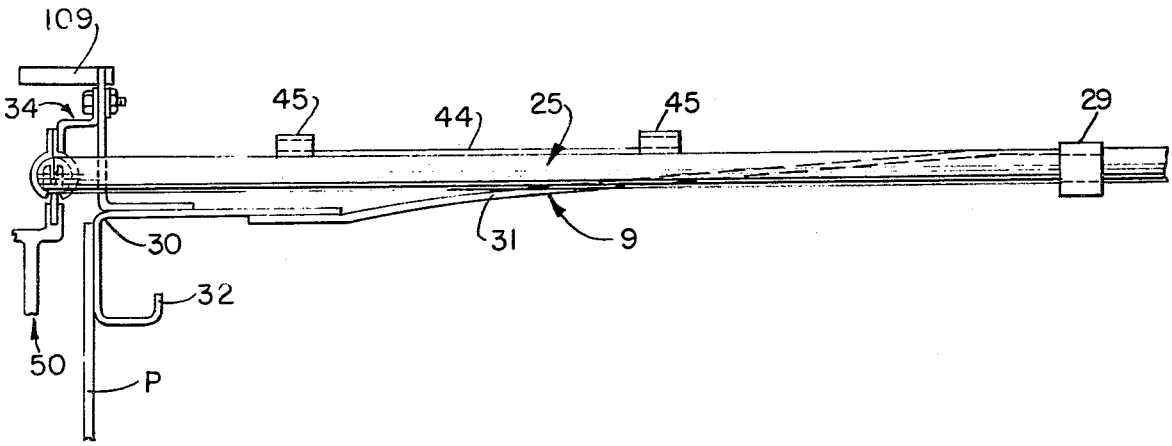
FIG. 18 is a partial front elevation illustrating the support member shown in FIG. 2.

The upper or elevated deck 9 as shown most clearly in FIGS. 1, 3 and 18, is crowned when viewed in end elevation such that the lateral edges 30 thereof are disposed in a plane substantially below the central longitudinal axis of the deck in that area aligned with the support member union 29. Strength is imparted to the deck by forming the deck edge 30 as a portion of a longitudinally extending beam or channel 32 having an outer, vertical face 32′. Such construction is highly desirable in a rail car according to the present invention from the standpoint of both economics and functionability. With this configuration, a lighter gage material may be utilized while still achieving the required strength and additionally, fluid draingage or run-off is provided.

Thus, appropriate mounting means must be provided to fixedly secure the support member 25 in the desired horizontal relationship. The mounting means for the support member 25 comprises numerous devices throughout the running extent of the support member as illustrated in FIGS. 2–6 of the drawings which clearly show the disposition of the support member along a line which is disposed beyond and/or above both the front edge 31 of the elevated deck 9 and the lateral edges 30

PIVOTAL SLIDABLE VEHICLE END ENCLOSURE

This invention relates generally, to closures for the end opening of vehicles and more particularly, to an improved end enclosure for rail cars adapted for transporting automobiles.

Displaceable closures for the end opening of rail cars are well known. U.S. Pat. Nos. 3,996,860 issued Dec. 14, 1976 and 4,084,516 issued Apr. 18, 1978, both assigned to the assignee of the present invention, illustrate examples of shiftable enclosures for a vehicle end opening comprising pairs of bi-fold door assemblies displaceable from a closed position wherein the assemblies substantially completely obstruct the car end opening, to an opened position wherein each door assembly is pivotally collapsed and shifted to a stowed position located parallel to a side wall of the car.

In both of the above patents, each door assembly comprises a pair of relatively large panels which are pivoted outwardly and away from the car end to provide a sandwiched condition prior to displacement adjacent a car side wall. Thus, it will be appreciated that sufficient clearance adjacent the exterior or interior of the car sides must also be available as the folded door assemblies are arcuately displaced to a stowed position outside or inside, respectively, the car side walls.

Many shippers prefer the security and protection afforded by end enclosures comprising a plurality of normally solid, non-yieldable panel sections and the construction provided by the present invention is intended to yield an improved arrangement offering advantages over many prior known devices. In this development, maximum security is provided by means of a pair of door assemblies each including a plurality of rigid, solid metal slats or panels hingedly connected to one another and which when shifted from a closed to an opened position, are slidably displaced along a straight and curved path and at all time, remain within the confines of the interior of the vehicle.

The supporting means for each of the two door assemblies at each car end comprises a single elongate, horizontally disposed support member disposed at a level above the plane of and/or beyond the edge of an elevated deck located within the interior of the car. This support member includes an end portion supporting and retaining each door assembly when in the closed position and is continuous with a side portion disposed substantially parallel to the car side walls and which is mounted along a line disposed exteriorly of each deck lateral edge whereupon the door assemblies when in the opened position are well spaced laterally of the elevated deck to provide maximum clearance for lading intended to be disposed thereupon.

It is desirable that rail cars employed for the transport of automobiles, whether of the single, bi-level or tri-level type, be covered over their tops by means of a roof structure as it is well known that without such top protection, the lading is subject to considerable damage, much of it due to vandalism. As a rule, this roof feature is used only in the West due to clearance problems in the East. Accordingly, the present invention proposes to include, as an alternative, a roof structure and in view of clearance restrictions and a desire to miminize wind resistance such a roof must include angularly disposed or inclined side walls. With this construction, problems are presented in providing security in the upper portion of the car end opening when door assemblies are employed having pivotal panels or slats. The referenced U.S. Pat. No. 4,084,516 discloses a partial solution wherein the outermost section of each door assembly is provided with an inwardly angularly disposed top-most security panel which nests within the car interior juxtaposed the car pitched roof section when in the opened position. Security within the upper portion of the end opening is provided in the present structure by means of a plurality of specifically configured panel sections rigidly affixed to or formed as extensions atop each of the vertically disposed main panel sections and which are inclined inwardly toward the car interior such that during displacement of each door assembly into the open position within the interior of the car, there is no interference between the plurality of inclined sections and/or the vehicle roof structure.

Accordingly, one of the primary objects of the present invention is to provide an improved vehicle end enclosure including a pair of door assemblies each comprising a plurality of preferably rigid imperforate panels hingedly joined to one another and suspended from a horizontal support member fixedly disposed above and/or transversely beyond an elevated deck within the vehicle interior.

Another object of the present invention is to provide an improved vehicle end enclosure including a pair of door assemblies each including a plurality of articulated solid metal panels suspended from and guided by a support member disposed for the most part above an elevated deck and located exteriorly of a lateral edge of the deck.

Still another object of the present invention is to provide an improved vehicle end enclosure for a vehicle having a pitched roof and including a pair of door assemblies each provided with a plurality of articulated main panel sections in turn each having a topmost inwardly directed panel section defining a trapezoidal configuration.

A further object of the present invention is to provide an improved vehicle end enclosure including a pair of door assemblies each including a plurality of hingedly connected panels suspended from an elongated support member and engaged therewith by tandem tracking elements attached relative the hinge axis joining the adjacent panel sections of the door assemblies.

With these and other objects in view which will more readily appear as the nature of the invention is better understood, the present invention consists in the novel construction, combination and arrangement of parts hereinafter more fully described, illustrated and claimed.

A preferred and practical embodiment of the invention is shown in the accompanying drawings in which:

FIG. 1 is an end elevation of a rail car provided with the end enclosure of the present invention and illustrates one door assembly in the closed position and the other door assembly in the opened or stowed position;

FIG. 2 is an enlarged fragmentary top plan view taken along the line 2—2 of FIG. 1;

FIG. 3 is a vertical sectional view taken along the line 3—3 of FIG. 2;

FIG. 4 is a vertical sectional view taken along the line 4—4 of FIG. 2;

FIG. 5 is a vertical sectional view taken along the line 5—5 of FIG. 2;

FIG. 6 is a vertical sectional view taken along the line 6—6 of FIG. 2;

thereof. As seen in FIG. 2, wherein the vehicle side wall 6 has been omitted for purpose of clarification, the side portion 26 of the support member 25 is disposed within a space S located between the deck 9 and car side wall 6. In this manner, the support member 25 will be seen to be spaced outwardly beyond the lateral edge 30 of the deck and likewise to be disposed well elevated with respect to the adjacent edge portion 30 of the deck 9.

The lateral edge 30 of the deck 9 in the area of the end of this deck which is disposed adjacent the end opening 2 of the car, is provided vertical support by means of a deck wing support plate P extending from the car floor 5 to the outer face 32' of the deck channel 32 and which in turn is backed up by an appropriate support column (not shown) extending to the floor.

Extending upwardly from the edge of the deck are a plurality of side brackets 33 from which depend a clamp device 34. The distal portion of each clamp device 34 includes a pair of spaced apart clamp elements 36—36 retained by a removable fastener 35 and which tightly engage the exterior periphery of the side portion 26 of the support member 25.

At this point, the specific configuration of the support member may be considered wherein it will be seen as in FIG. 3, that this member comprises a single continuous tubular element extending from the rear end 37 to the front end 28 and preferably defines a circular configuration having an open passage 38 throughout its bottom-most point.

To facilitate the ease of displacement of each door assembly 15 or 16 between its two alternate positions, as will be discussed in detail hereinafter, it will be appreciated that the curved portion 41 of the support member 25 should describe as large an internal angle as possible and accordingly, it will be seen that the sweep or angular extent of this curved portion 41 is kept as large as possible.

The end portion 27 of the support member 25 is mounted forward of and for the most part, above the elevated deck front edge 31 by means of an appropriate brace 43 welded in turn to the top surface of the deck 9 and to the inner-most periphery of the support member as shown most clearly in FIG. 5 of the drawings. This attachment appears in the area of one of the bridge kits, a well known structure in this art providing means by which an external ramp (not shown) is attached adjacent a deck front edge for the loading and unloading of automobiles thereupon. A ramp 44 is affixed adjacent the top surface of the support member 25 as well as the top surface of the elevated deck to further facilitate loading and unloading. Attachment for the external ramp is accomplished by a pair of sleeves 45—45 located outside the lateral limits of the ramp 44 or automobile wheel line and affixed atop the support member and which cooperate with the external ramp and provide means for locking same to the deck kit. At other points along the running extent of the end portion 27 of the support member 25, attachment adjacent the deck front edge 31 may be provided either by directly welding thereto or by the provision of additional attachment members 46 such as illustrated in FIG. 6 of the drawings.

FIG. 2 illustrates the provision of two additional components for each car end support member 25 comprising a pair of enlarged access openings 48, one formed in the upper portion of the support member adjacent each deck lateral edge 30. The purpose of the two openings 48 which may include suitable removable covers (not shown) will be described hereinafter.

Each door assembly 15 and 16 is supported, in a suspended manner, from the support member 25 by means of a plurality of hanger assemblies, generally designated 50 and which are mounted in association with the upper hinge assemblies 21. These hanger assemblies are illustrated most clearly in FIGS. 7 and 8 of the drawings and are preferably co-located with each one of the upper hinge assemblies 21 although, depending upon the size and number of panels making up any one door assembly, it may be possible to add or omit one or more of the hanger assemblies. Each hanger assembly includes a vertical bar 51 terminating in a top offset 52 and an opposed bottom offset 53. The two offsets are vertically aligned and each provided with a bore 54 with the two offsets spaced apart a sufficient distance to straddle the male and female elements of any one of the upper hinge assemblies 21. In this manner, the two offsets 52–53 may be disposed between two adjacent, spaced apart panels of the door assembly with the opposite ends of the related hinge pin 55 providing a close fit within the two bores 54—54 whereafter each hanger assembly and hinge assembly may be retained in the position shown in FIG. 7 by the insertion of an appropriate fastener such as a roll pin 39 etc. through the respective hole 56 formed adjacent the lower end of the hinge pin 55. The upper end of the hinge pin is provided with an enlargement such as the integral cap 40 thereby offering a tamper-resistant connection of the panels and hanger and hinge assemblies. The top offset 52 projects away from the rear face of the adjacent door assembly panels and includes a pair of spaced apart upstanding flanges 57—57 which serve as means for the mounting of a trolley member comprising two groups of tandem tracking elements 58. These tracking elements 58 may comprise rollers or wheels and any appropriate anti-friction means such as bearings to insure minimum resistance against their turning upon the respective axles 59 and the four tracking elements 58 of each hanger assembly 50 are in turn carried by a common pendent mounting arm 60 having its lower portion disposed between the upstanding flanges 57 and pivotally attached thereto as by the fastener or axle 61.

Figure 9:
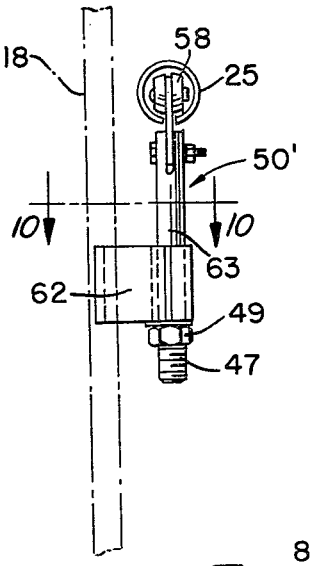
FIG. 9 is a vertical sectional view taken along the line 9—9 of FIG. 1.
Figure 10:
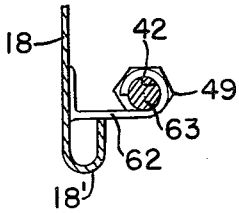
FIG. 10 is a horizontal sectional view taken along the line 10—10 of FIG. 9.

FIG. 9 illustrates the manner of providing a hanger assembly 50' having tracking elements 58 adjacent the exposed edge of the inner slat or panel 18 of each door assembly 15 or 16. Since there is no hinge assembly associated with the panel edge 18', a bracket 62 is suitably affixed with respect to the rear surface of the panel 18 just inwardly of its free edge 18' and includes a bore 42 for slidably receiving a post 63. This post is provided with a top portion for receiving the pendent mounting arm 60 of a tandem arrangement of tracking elements 58. The lower end of the post 63 projects beneath the bracket 62 and is threaded as at 47 to receive an appropriate fastener such as the nut 49. In this manner, vertical adjustment of the position of the associated tracking elements 58 may be readily achieved by manipulation of the nut 49. The opposite outer panel 19 also is provided with a hanger assembly 50 which as shown in FIG. 1 is attached to the female hinge element adjacent the panel edge 19'.

Figure 7:
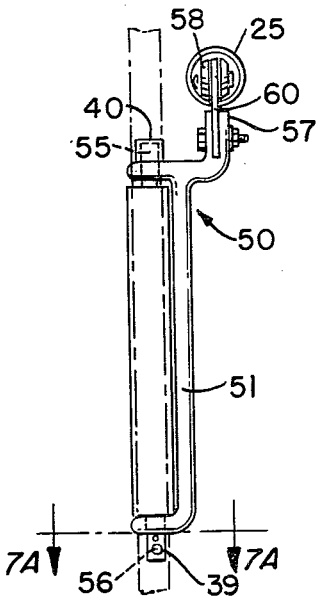
FIG. 7 is a vertical sectional view taken along the line 7—7 of FIG. 1.
Figure 8:
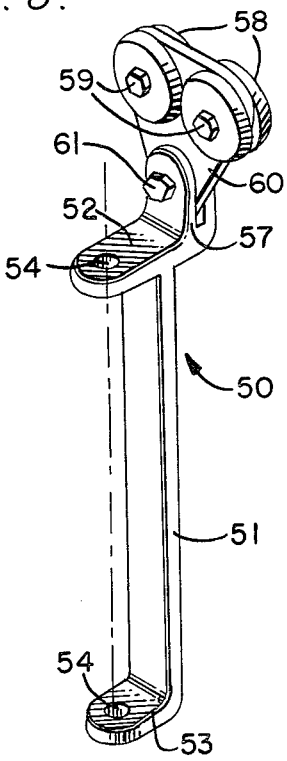
FIG. 8 is an enlarged perspective view of the hanger mechanism shown in FIG. 7.

Having considered the above FIGS. 7–9, it will now be understood that all of the tracking elements 58 of the various hanger assemblies 50 and 50' are adapted to be disposed within the cylindrical interior I of the support member 25 with the pendent mounting arms 60 thereof extending downwardly through the open passage 38 of the support member 25 while the bottom of the four treads of the tracking elements of each hanger assembly engage the inner periphery of the support member on either side of the bottom medial open passage 38.

The advantage of employing pairs of tandem tracking elements, each carried by a common mounting arm which in turn is pivotally attached to the top of the hanger assembly vertical arm 51, will be appreciated during displacement of the door assemblies between their alternate positions. During this displacement, each door assembly 15 or 16 may be laterally shifted upon the application of lateral force to any one of the plurality of panels making up that door assembly and since the entire weight of the door assembly is carried along the single line defined by the support member 25, it will follow that during lateral displacement of the door assembly there will be a natural tendency for the bottom door panel edges 64 to be canted or laterally displaced a slightly greater degree than that portion of the respective panels juxtaposed the support member 25. However, due to the provision of the tandem tracking elements, which in turn are mounted upon a pivotal axis 61, all of the tracking elements associated with any one of the door assemblies will at all times be urged to distribute the load and remain fully seated with the lower portion of their treads constantly engaging the lower portion of the inner periphery of the support member 25. This feature discourages vertical or angular displacement of the tracking elements from their normal engagement with the bottom of the support member interior periphery thereby precluding jamming of the tracking elements against the upper portion of the interior periphery of the support member which latter action quite obviously would hinder a more effortless displacement of a door assembly between its alternate positions.

Figure 11:
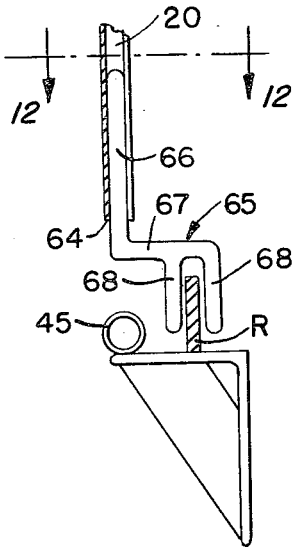
FIG. 11 is a vertical sectional view taken along the line 11—11 of FIG. 1.
Figure 12:
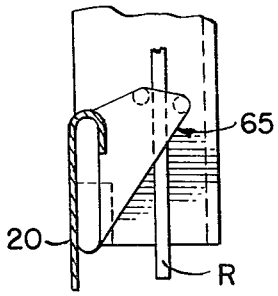
FIG. 12 is a horizontal sectional view taken along the line 12—12 of FIG. 11.

Although the sole support for each door assembly is attributed to the support member 25 and incorporated hanger assemblies 50—50' it follows that suitable guide means must be provided adjacent the bottom edges 64 of the respective panels of each door assembly. Such guide means must not hinder the operation of the door assemblies and must also provide security for the lower portion of the door assemblies so that unwarranted access may not be gained within the car interior 11 by pulling out the panel bottom edges 64 away from the end opening 2. FIGS. 11, 12 and 19 of the drawings, illustrate guide means associated with all of the panels 18–20 and which comprises a vertically extending guide rail R projecting upwardly from the car frame or floor along a line substantially parallel to and vertically disposed beneath the path of the support member 25. The guide rail R for each door assembly extends from adjacent one car side wall around to the end opening of the car and to the car longitudinal centerline. Carried by the lower portion of all the panels is a panel guide, generally designated 65 and which includes a vertical attachment arm 66 fixedly attached with respect to the panel rear face and from which rearwardly extends a bottom offset 67 located beneath the panel bottom edges. As shown in FIG. 11, a pair of spaced apart fingers or pins 68 extend downwardly from the offset 67 and are spaced apart a sufficient distance to freely straddle the upstanding guide rail R.

Figure 13:
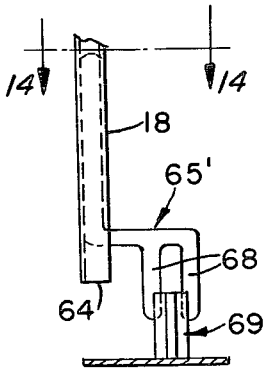
FIG. 13 is a vertical sectional view taken along the line 13—13 of FIG. 1.
Figure 14:
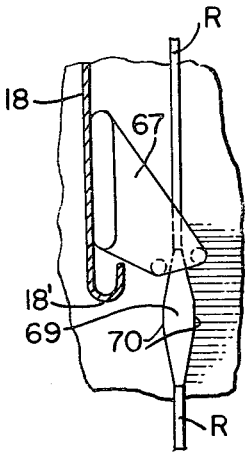
FIG. 14 is a horizontal sectional view taken along the line 14—14 of FIG. 13.

FIGS. 13 and 14 illustrates guide means for the lower portion of the door assembly and as carried by each inner panel 18 which will be understood to be disposed substantially along the medial longitudinal axis of the car when in the closed position as shown in the left-hand portion of FIG. 1 of the drawings. This panel guide 65' carried by the inner panel 18 includes an offset 67' extending to a point adjacent the panel edge 18' so that when the door assembly is in the closed position, the two depending pins 68—68 thereof are located close to the car medial axis. Instead of freely straddling a fixed, constant-thickness guide rail R as in the case of the remaining panel guides 65, the panel guide 65' associated with each of the inner panels 18 is adapted to provide a positive fixed abutment for the lower portion of the panels 18. This is achieved by means of an upstanding guide stop 69 extending from the car floor 5 along the medial axis of the car and which, from FIG. 14 will be seen to include tapered front and rear walls 70—70 adapted to form a positive abutment for the two depending pins 68—68 when the door assembly 15 is fully closed. The symmetrical configuration of the guide stop 69 allows the stop to simultaneously serve the same function with the other door assembly 16 and its panel guide 65' which is a mirror image of that illustrated in FIGS. 13 and 14.

Means are provided to positively retain the two door assemblies in the closed position when fully sealing off the end opening 2. As already described, a guide stop 69 located along the axial center-line of the car floor 5 engages and retains the bottom edges 64 of the two door assemblies when in the fully closed position and associated with the center portion of each of the decks 8 and 9 is a T-bar 73 of well-known construction. It now only remains to provide positive locking means for securing the juxtaposed edges 18'—18' of the two closed door assemblies 15 and 16 in a secure manner and this is provided by means of the lock assembly 74 disclosed most clearly in FIG. 16 and 17 of the drawings.

The lock assembly 74 is carried by one of the inner door assembly panels 18 and is attached thereto by means of a base plate 75 suitably affixed to the rear face of the panel and through which extends an operating shaft 76 attached to manipulating means such as the handle 77 projecting from the outer face of the door panel. Quite obviously, other appropriate manipulating means may be utilized, such as a socket element adapted to receive a mating tool. Fixed to the inner end of the operating shaft 76 is a crank arm 78 to which is pivotally attached one end of an offset actuating link 79, the other end of which is pivotally connected to the pivot arm 80. The medial portion of this pivot arm 80 is journaled to a pivot shaft 81 while the opposite free end of the arm 80 is formed with a latch hook 82. With this structure in mind, it will be seen that displacement of the handle 77 between the alternate positions shown in FIG. 17 produces a concurrent displacement of the latch hook 82 between the alternate positions shown in this figure.

Figure 15:
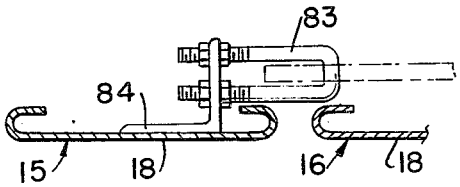
FIG. 15 is a horizontal sectional view taken along the line 15—15 of FIG. 1.
Figure 16:
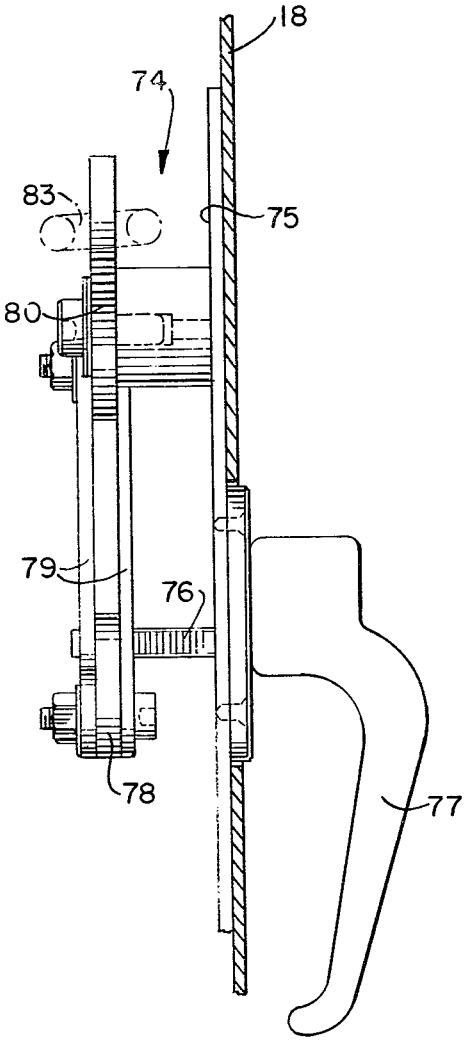
FIG. 16 is an enlarged vertical sectional view taken along the line 16—16 of FIG. 1.
Figure 17:
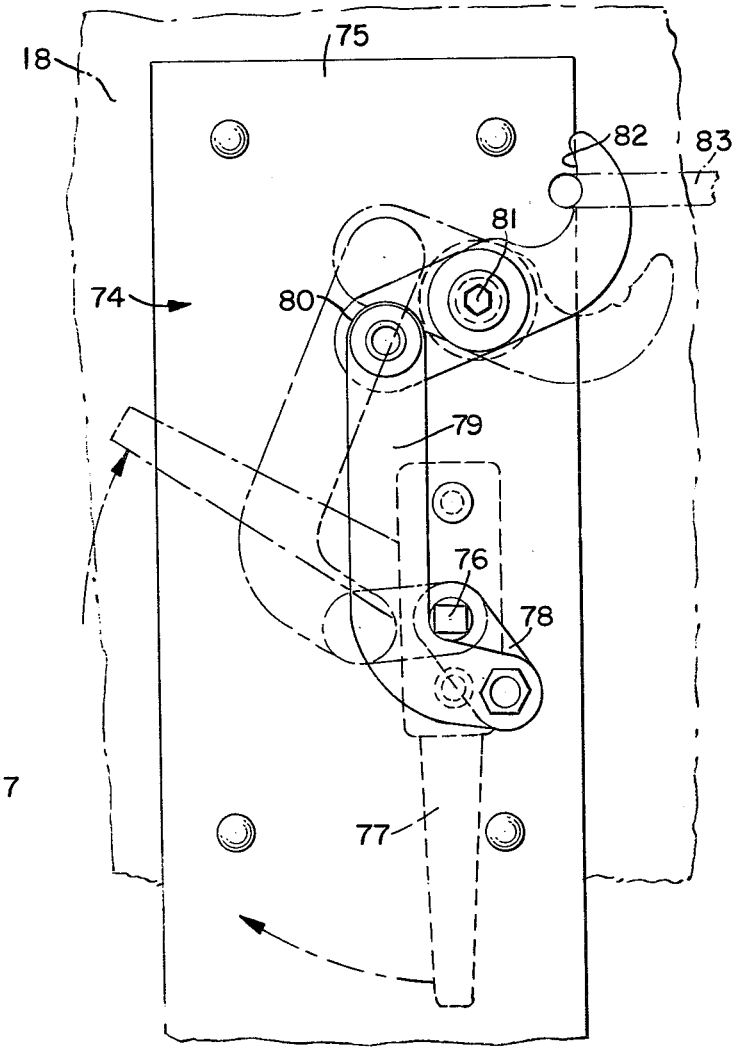
FIG. 17 is a rear elevation of the lock assembly shown in FIG. 16.

The lock assembly is intended to cooperate with a keeper 83 carried by a bracket 84 on the inner face of the inner panel 18 of the other door assembly and as shown most clearly in FIGS. 15 and 16, this keeper 83 comprises a U-bolt behind which the latch hook 82 of the lock assembly is disposed when the two door assemblies are in the closed position of FIG. 17. With the foregoing structure in mind, it will be appreciated that a positive locking action is achieved in view of the offset construction of the actuating link 79 and the relative position of the crank arm 78 which insures a past-center disposition of the lock elements and thus precludes unlocking of the two closed door assemblies without displacement of the handle 77 away from its full-line position in FIG. 17. Quite obviously, additional secure means may be provided such as a key-actuated locking cylinder or provision for a padlock may be included to prevent unwarranted operation of the handle 17.

In addition to the lock assembly which positively latches together the two door assemblies 15–16 when in the closed position, means are provided to independently lock or secure each door assembly when fully disposed in the open position, substantially parallel to the car side walls. This open lock structure will be understood to positively retain each of the two door assemblies in the stowed position such as the door assembly 16 shown in FIG. 1, to preclude unwanted shifting of same to a partially or fully closed position. Also, bumper or stop means are carried by both of the inner and outer panels 18–19 to further limit the degree of travel of each door assembly as it is displaced between the alternate open and closed positions.

The open door lock mechanism, generally designated 94, comprises pivotal latch members 95 and actuating means 96 attached to a stationary member such as the vertical support plate P and which will be understood to be juxtaposed the inside face of the inner panel 18 of a door assembly when fully open as in the case of door assembly 16 shown in FIG. 1. The lock mechanism 94 for each door assembly is shown in detail in FIG. 22 and preferably includes a pair of the latch members 95 so as to provide two points of latching in order to more securely retain each door assembly in the open position. Accordingly, a latch mount 97 will be seen to be fixedly secured to the support plate P in the area beneath each deck 8 and 9 and serves to receive the base 98 of one latch member 95 which is pivotally attached thereto as at 99.

Each latch member cooperates with a keeper 100 fixed to the inside face of an inner door panel and which is constructed in a manner to automatically displace the pivotal latch members 95 as a door assembly is fully opened. In this respect, each latch member includes an inclined nose 101 leading rearwardly to an undercut notch portion or catch 102 while the cooperating keeper 100 includes a rear cam surface 103 and front catch surface 104. Considering the disposition of the components as shown in FIG. 22 it will follow that upon the displacement of either door assembly into its open position intermediate the upright plate P and car side wall 6 or 7, the keeper rear cam surface 103 engages the latch nose 101 to force the latch member upwardly about its pivot 99 until the keeper is past the catch 102 after which gravity urges the latch member 95 to the engaged position illustrated in full lines in this drawing figure.

To release the engaged lock mechanism 94 when it is desired to displace the door assembly to the closed position, a latch operator 105 is manually shifted about its pivot 106 in the direction of the arrow 105' of FIG. 22. This action downwardly displaces the pivotally attached actuating rod 107 which in turn is pivotally connected as at 108 to the base 98 of each involved latch member 95 at a point rearward of the pivot 99 whereupon each attached latch member is elevated in the direction of the arrows 95' to clear the catch 102 from the keeper 100. From the above it will be seen that a gravityactuated lock mechanism is provided to positively secure each door assembly 15–16 in the open position and includes mechanically operated means for releasing same when the door assemblies are to be displaced to the closed position.

The stop and bumper means assisting in limiting the degree of travel of each door assembly when displaced to both extreme positions includes bumper elements projecting inwardly from the inside face of each inner and outer panel 18,19 and engageable with stationary stop members mounted adjacent the rail R and support member 25. As shown in FIGS. 1, 2 and 3, each rearmost clamp assembly 34 includes an upper stop 109 projecting outwardly and above the support member 25. Likewise each rail R includes a lower stop 110 fixedly mounted adjacent the rear portion of the rail as shown in FIG. 19. These two stops 109, 110 cooperate with bumper elements 111,112 attached to the inside face of each outer panel 19 as shown in FIG. 1, 2 and 19, respectively. The upper bumper 111 may comprise an angle plate and extends inwardly a sufficient distance to abut the forward face of the upper stop 109 when the latch mechanism 94 is engaged as shown in FIG. 22. The lower bumper 112 on the other hand includes a loop member having an outer nose or hook 113 bridging two arms 114—114 and defining a passageway 115 therebetween as shown in FIGS. 19 and 23. The nose 113 of this lower bumper will be understood to engage the lower stop 110 concurrently with the above described contact between the upper bumper 111 and stop 109 to offer a positive limitation to the rearward displacement of both the upper and lower portions of each door assembly.

Although the upper portion of the inner panel 18 of each door assembly is adequately secured by means of the lock mechanism 94 when the door assemblies are fully open, further bumper means are provided adjacent the bottom of each inner panel 18 to positively secure this latter area of the opened door assemblies. As shown in FIGS. 19 and 1, the lower portion of the inner panel 18 includes a lower bumper 116 attached to the inside face thereof and comprising a configuration somewhat similar to the bumper 112 carried by the outer panels 19. In the case of the bumper 116, the outer nose or hook 113 is adjacent and spaced from the panel edge 18' and is positioned so as to engage the bottom of a forward facing throat 117 formed in a stationary stop member 118. As shown most clearly in FIGS. 19 and 24, the stop member 118 includes a base 119 joined to an outer arm 120 by means of a medial neck 121 such that a second, rearwardly facing throat 122 is also provided. The stop member base 119 is affixed, as by welding, to suitable stationary means such as the vertical plate P so that when the lock mechanism 94 is engaged with the door keepers 100, all of the bumpers 111, 112 and 116 engage their respective stop members 109, 110 and 118.

FIG. 24 illustrates the dual function of the stop member 118 of FIG. 19 when a door assembly is fully closed and wherein it will be seen that the hook 113 of the rear lower bumper 112 has become fully seated within the bottom of the rearwardly facing throat 122 so as to stabilize the lower portion of the door assembly in the area of the outer panel 19. The upper area of the same panel also is positively limited in its closing movement by means of a forward upper stop 123 affixed to and extending outwardly from the support member curved portion 41. When a door assembly 15 or 16 is fully closed, it will be understood that the rear upper bumper 111 abuts this forward stop 123 to limit the closing movement of the upper area of the outer panel 19, as shown in FIG. 2.

The cross sectional configuration of each of the panels forming the two door assemblies is shown most clearly in FIG. 2 of the drawings, wherein each panel preferably comprises a sheet metal or other suitable construction resulting in a relatively light-weight door assembly. Adequate strength to preclude buckling or twisting of the individual panels is obtained by means of the C-shaped configuration including the two opposite rolled lateral edges 85—85. As viewed in FIGS. 20–21, this construction carries through to the individual top panel section 86 each having a bottom edge 87 affixed to a top edge 88 of the plurality of door assembly panels. Alternatively, the top panel sections may comprise integral extensions of the main panels and additionally, it will be appreciated that in the case of roofless cars, such top panel sections may be entirely eliminated. Although the cross sectional configuration of these top panel sections 86 likewise defines a C-shaped configuration in elevation, it will be seen from FIG. 1 that the side edges 89 of these panel sections are tapered inwardly from the bottom edge 87 to the top 90 thereof such that a trapezoidal configuration is produced. In instances wherein the top panel section are separate elements, the juxtaposed edges of the top panel sections 86 and the main door assembly panels may be butt-welded or mechanically attached. A reinforcement plate 91 as shown in FIG. 20 may be welded to the rear of the two adjacent components and is angularly disposed to maintain the inwardly directed inclination of the top panel sections 86 into the area of the upper portion 92 of the car end opening. The foregoing inward inclination of the top panel sections 86 allows accommodation of these panel sections when each door assembly is moved into the stowed position as shown in the right-hand portion of FIG. 1 of the drawings, while the inward taper of the side edges 80–89 produces an inverted triangular space 93 between the panel sections 86 when the door assembly is in the closed position but allows an interference-free operation of the door assembly as it negotiates the curved portion 41 of the support member 25 during displacement between the two alternate positions.

Removal, maintenance or replacement of either of the components of the respective door assemblies is facilitated by means of the previously mentioned access opening 48 formed in the upper portion of the periphery of each support member section 25' and 25''. Each access opening 48 will be understood to have a cross sectional area large enough to accommodate the passage of the various tracking elements 58 associated with each of the hanger assemblies 50–50'. With this arrangement, it is possible merely by laterally shifting the door assembly, to remove one or more of the tracking elements through an access opening 48 without having to remove the support member 25 or the entire door assemblies 15 or 16. It is only necessary to remove the fastener 61 located beneath the respective tracking elements 58 whereafter, with the involved tracking elements located beneath either one of the access openings 48, it may then be easily urged upwardly together with its mounting arm 60 through the access opening to effect its removal.

We claim:

1. An end enclosure for a transport vehicle having a floor and two side walls defining a vehicle interior therebetween terminating in an end opening, at least one elevated deck spaced above said floor and having lateral edges spaced inwardly from said side walls and a front edge juxtaposed said end opening, said enclosure comprising a pair of door assemblies adapted to be displaced between a closed position overlying said end opening and an opened position spaced outwardly of a respective one of said deck lateral edges and disposed fully within said vehicle interior, said door assemblies each including a plurality of vertically disposed adjacent panels bounded by an inner and outer panel, hinge means intermediate and pivotally joining adjacent ones of said panels, an elongated support member disposed within said vehicle interior in a horizontal plane, said support member having an end portion disposed outwardly beyond said deck front edge and joined in a continuous curved manner with side portions respectively disposed above and outwardly of said deck lateral edges, means fixedly mounting said support member relative said deck, means suspending said door assemblies from and outwardly of said support member, said suspension means including a plurality of hanger assemblies attached to said panel hinge means, said hinge means including male and female hinge elements joined by a hinge pin, said hanger assemblies each provided with a pair of opposed horizontal offset elements projecting outwardly toward each said door assembly and engaging opposite ends of said hinge pins to captively support said door assemblies, said hanger assemblies each provided with a tracking element disposed within said support member, and panel guide means carried by the bottom of said door assemblies cooperating with guide means adjacent said vehicle floor, said guide means adjacent said vehicle floor including an upstanding rail extending substantially continously throughout the extent of displacement of said two door assemblies, said panel guide means including a plurality of individual spaced-apart guide pins projecting downwardly from said panels and straddling said rail, forward and rearward bumpers projecting inwardly from said inner and outer panels respectively, forward and rearward stops mounted inwardly of said vehicle side walls adjacent said floor guide means and respectively engaged by said forward and rearward bumpers when each said door assembly is fully disposed in said opened position, said forward stop mounted at a position selected to engage said rearward bumper when each said door assembly is fully disposed in said closed position wherby, lateral force applied to any one of said panels concurrently displaces all said panels of its respective said door assembly between said closed and opened positions.

2. An end enclosure according to claim 1 wherein, said support member comprises a tubular element provided with a bottom passageway extending substantially throughout its length.

3. An end enclosure according to claim 1 wherein, said tracking elements include at least one wheel, a mounting arm pivotally attached relative the axis of said wheel and extending downwardly to a point below said support member, each said hanger assembly having a vertical bar carried by its respective door assembly, flange means on said bar and means fastening said flange means to said downwardly extending mounting arm.

4. An end enclosure according to claim 3 wherein, each said tracking element includes a pair of dual wheel assemblies.

5. An end enclosure according to claim 3 wherein, said fastening means comprises a removable fastener, and said elongated support member having at least one opening in its upper portion adjacent each lateral edge of said elevated deck whereby, upon positioning individual tracking elements beneath said opening said tracking element may be vertically removed therethrough following disassembly of said removable fastener.

6. An end enclosure according to claim 3 wherein, at least one hanger assembly on each said door assembly is vertically adjustable relative said door assembly.

7. An end enclosure according to claim 3 wherein, said support member is substantially circular in cross-section, said support member having a bottom-most passageway extending substantially throughout its length, and said mounting arm extends through said passageway.

8. An end enclosure according to claim 1 wherein, said panels comprise substantially rigid imperforate members.

9. An end enclosure according to claim 1 wherein, said panels each include a main panel section substantially vertically disposed and extending from a point juxtaposed said vehicle floor to an elevation adjacent the plane of said side walls, a top panel section extending upwardly and inwardly from said main panel section and said top panel sections having side edges tapered inwardly from said main panel sections.

10. An end enclosure according to claim 1 wherein said two inner panels juxtaposed when said door assemblies are in said closed position, closed door lock means carried by said two inner panels and, said lock means including a pivotal lock assembly on one said inner panel and a keeper on the other said inner panel.

11. An end enclosure according to claim 10 wherein, said lock assembly includes a plurality of pivotal links carried by the interior of one said inner panel, manipulating means on the exterior of said one inner panel joined to one said link and operable to pivotally displace all said links to an over-center disposition, and one said link provided with latch means engageable with said keeper.

12. An end enclosure according to claim 1 including a fixed vertical member within said vehicle interior and juxtaposed each said inner panel when each said door assembly is fully disposed in said opened position, an open door lock mechanism operable to positively retain each said opened door assembly, said lock mechanism including a latch member pivotally supported by said vertical member, a keeper on said inner panel projecting inwardly of said vehichle interior, said latch member provided with a catch whereby when said door assembly is fully opened said keeper pivotally displaces said latch member and is engaged by said catch, and actuating means carried by said vertical member and operable to pivotally displace said latch member to disengage said catch from said keeper and allow closing of said door assembly.

13. An end enclosure according to claim 12 including, a plurality of said latch members and keepers vertically spaced apart in each said latch mechanism, said actuating means including an actuating rod pivotally attched to said plurality of latch members and manually operable means for displacing said rod.

14. An end enclosure according to claim 1 wherein, said bumper means includes an upper bumper element projecting inwardly from said outer panel adjacent the path of said elongated support member, said stop means including forward and rearward upper stops fixedly mounted adjacent said support member whereby, said upper bumper element alternately engages said forward and rearward upper stops as said door assembly is fully displaced to its closed and opened positions, respectively.

15. An end enclosure according to claim 1 wherein, said forward lower stop includes first engageable means on one side thereof abutting said forward lower bumper when said door assembly is fully opened and said forward lower stop having second engageable means on an opposite side thereof abutting said rearward lower bumper when said door assembly is fully closed.

* * * * *